US009022615B2

(12) United States Patent
Miyashita et al.

(10) Patent No.: US 9,022,615 B2
(45) Date of Patent: May 5, 2015

(54) LIGHT-EMITTING MODULE INCLUDING HOUSING WITH PROTRUSION

(75) Inventors: Takumi Miyashita, Fujiyoshida (JP); Ichiro Miyashita, Fujiyoshida (JP); Ken Kobayashi, Fujiyoshida (JP)

(73) Assignees: Citizen Electronics Co., Ltd., Yamanashi-Ken (JP); Citizen Holdings Co., Ltd., Tokyo (JP)

( * ) Notice: Subject to any disclaimer, the term of this patent is extended or adjusted under 35 U.S.C. 154(b) by 123 days.

(21) Appl. No.: 13/279,670

(22) Filed: Oct. 24, 2011

(65) Prior Publication Data

US 2012/0099328 A1 Apr. 26, 2012

(30) Foreign Application Priority Data

Oct. 23, 2010 (JP) ..... P-2010-238071

(51) Int. Cl.
*F21V 3/00* (2006.01)
*F21K 99/00* (2010.01)

(52) U.S. Cl.
CPC ..... *F21K 9/30* (2013.01)

(58) Field of Classification Search
CPC ..... F21K 9/30
USPC ..... 362/311.01
See application file for complete search history.

(56) References Cited

U.S. PATENT DOCUMENTS 5,678,913 A * 10/1997 Ishimaru et al. ..... 362/26
2008/0037252 A1* 2/2008 Nii et al. ..... 362/267
2008/0142822 A1* 6/2008 Kim et al. ..... 257/98
2008/0186703 A1* 8/2008 Lou et al. ..... 362/247
2009/0053839 A1* 2/2009 Kim et al. ..... 438/26
2009/0134424 A1 5/2009 Liang et al.
2009/0283785 A1* 11/2009 Kim ..... 257/98

FOREIGN PATENT DOCUMENTS

JP 2006319111 A 11/2006
JP 2009021144 A 1/2009
JP 2009-76326 A 4/2009
JP 2009130349 A 6/2009
JP 2010-67415 A 3/2010

OTHER PUBLICATIONS

Notice of Reason for Rejection in corresponding Japanese patent application No. JP2010-238071, Issued: Mar. 5, 2014. and English translation of at least a portion thereof.

* cited by examiner

*Primary Examiner* — Anh Mai
*Assistant Examiner* — Hana Featherly
(74) *Attorney, Agent, or Firm* — Browdy and Neimark, PLLC

(57) ABSTRACT

A light-emitting module of the present invention comprises: a light source in which an LED element is disposed on a substrate and electrodes electrically connected to the LED element are provided on the substrate; a metal plate on which the light source is disposed; lead wires connected to the electrodes directly or via other electrode pattern; and a housing made of resin fixed onto the metal plate and housing the light source therein. Moreover, the housing includes a hole opening above the light source, and includes at least one pair of protrusions that protrude facing one another inside the hole and apply a bias to the light source to press the light source onto a metal plate side.

20 Claims, 10 Drawing Sheets

LIGHT-EMITTING MODULE INCLUDING HOUSING WITH PROTRUSION

CROSS-REFERENCE TO RELATED APPLICATION

This application is based on and claims the priority benefit of Japanese Patent Application No. 2010-238071, filed on Oct. 23, 2010, the disclosure of which is incorporated herein by reference in its entirety.

BACKGROUND OF THE INVENTION

1. Field of the Invention

The present invention relates to a light-emitting module including a light source and used for a lighting fixture.

2. Description of the Related Art

In recent years, lighting fixtures including a light source with a light-emitting diode element (hereinafter referred to as "LED element") to emit white light are being broadly and widely adopted. In such a high-output light source for general lighting, because the LED element is a light-emitting body that emits light by application of current, the LED element tends to be heated, and as a result, such a temperature rise of the LED element causes product lifetime to be shortened, hence there is a need to connect the LED element to a metal member such as a metal plate or a heat sink made from aluminum to dissipate heat, and thereby control temperature rise in the LED element.

For example, there is proposed a lighting fixture comprising a light-emitting module and a fixture main body, the light-emitting module being mounted with a plurality of light sources each employing a plurality of LED elements, and the fixture main body being of metal and including a module attaching portion for attaching the light-emitting module by fixing screws (refer to JP 2009-76326 A).

In this lighting fixture, the light sources are joined onto a base substrate of the light-emitting module by a thermosetting fixing material (resin sheet). In addition, the base substrate is fixed to the module attaching portion using the fixing screws or the above-mentioned thermosetting fixing material.

Moreover, proposed in another example is a lighting fixture which has a light-emitting module mounted on a housing thereof, the light-emitting module having a circuit board and a light-distribution controlling lens disposed therein, the circuit board being mounted with LED elements (refer to JP 2010-67415 A).

In this lighting fixture, the circuit board is fixed to a heat-conducting sheet, a heat-conducting plate, and the light-distribution controlling lens by assembly screws, and the light-emitting module is fixed to the housing by fixing screws.

However, the above-described conventional technology leaves the following problems. That is, conventionally, as in the technology described in JP 2009-76326 A, the light sources mounted with the LED elements are fixed to the base substrate which is of metal by an adhesive material such as the thermosetting fixing material; however, the light sources attain a high-temperature state due to heat generation in the LED elements and a thermal expansion differential occurs between the light sources and the base substrate, hence there has been a disadvantage that the adhesive material deteriorates with long-term use resulting in a drop in adhesive strength, heat conductivity and so on, which leads to a lowering of reliability.

As a result, mechanical fixing by screws and the like was required as in the technology described in JP 2010-67415 A, but there has been a problem that, when the substrate mounted with LED elements is screwed onto a metal member like a base plate, electrical insulation properties deteriorate by way of the screws and screw holes, and insulation withstand voltage and so on with external is reduced.

SUMMARY OF THE INVENTION

The present invention, proposed in view of the above-described problems, has an object of solving the above-described problems.

A light-emitting module according to an embodiment of the present invention may include a metal plate, a light source disposed on the metal plate, and a housing made of resin, including a hole, and secured to the metal plate with the light source positioned in the hole, and the housing includes at least one pair of protrusions that hold the light source against the metal plate. As the at least one pair of protrusions flexibly hold the light source against the metal plate, the light source is secured to the metal plate by the at least one pair of protrusions.

The housing may include an inner surface demarcating the hole, and the at least one pair of protrusions may protrude from the inner surface of the housing.

Also, the protrusions in each pair of the at least one pair of protrusions may protrude from opposite positions of the inner surface of the housing.

Each of the protrusions in the at least one pair of protrusions may include a taper at a position that holds the light source and is adjacent to the light source. The taper may be provided at an upper end of the each of the protrusions in the at least one pair of protrusions.

A light-emitting module according to another embodiment of the present invention may include a metal plate, a light source disposed on the metal plate and including a substrate, at least two electrodes provided on the substrate, and at least one light-emitting diode element that is mounted on the substrate and electrically connected to the at least two electrodes provided on the substrate, and a housing made of resin, including a hole and secured to the metal plate with the light source positioned in the hole, and the housing includes an inner surface that demarcates the hole, and at least one pair of protrusions protrude from the inner surface demarcating the hole and hold the light source against the metal plate, and at least two lead wires being electrically connected to the at least two electrodes provided on the substrate.

In addition, the light-emitting module of the present invention may be provided with a drive circuit for driving the LED element, the drive circuit being provided on the metal plate at a position around the light source.

Moreover, the light-emitting module of the present invention may comprise a light-transmitting cover covering the hole of the housing and secured to the housing, and a white sheet provided between the housing and the light-transmitting cover and including at least one opening provided at a position above the at least one LED element.

Furthermore, the light-emitting module of the present invention may include a lens member provided at the hole of the housing to collect light emitted from the light source.

DETAILED DESCRIPTION OF THE PREFERRED EMBODIMENTS

Figure 1:
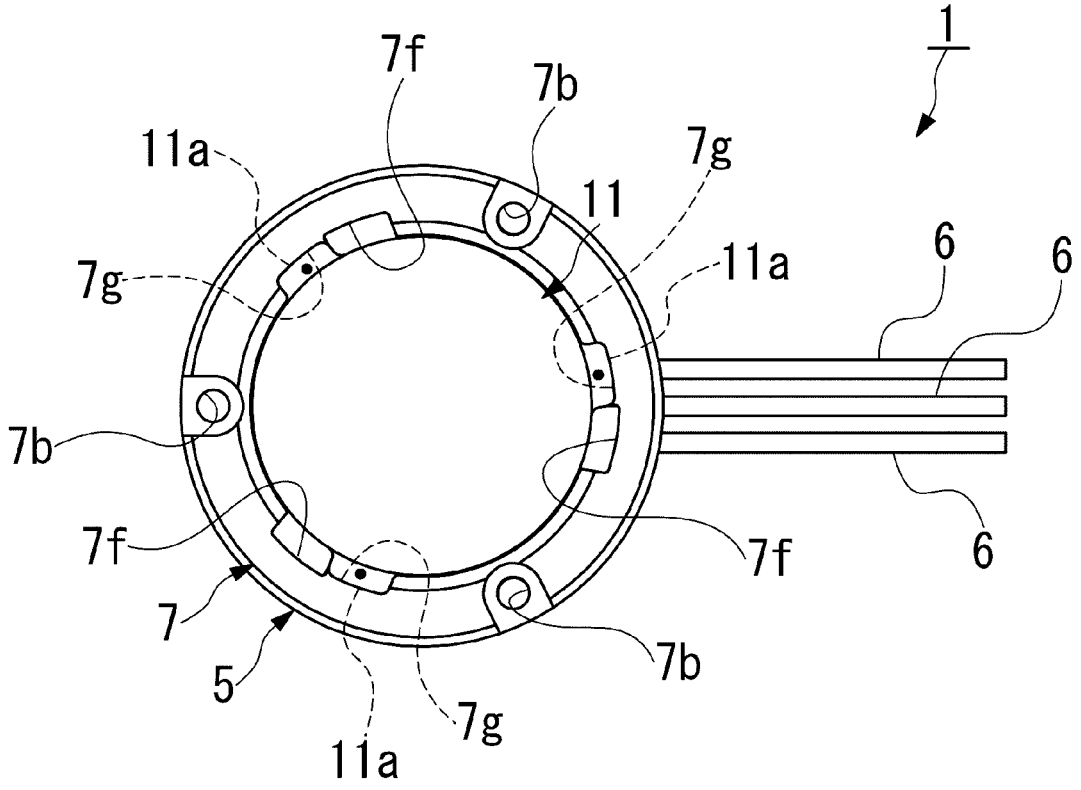
FIG. 1 is a plan view showing a first embodiment of a light-emitting module according to the present invention.
Figure 2:
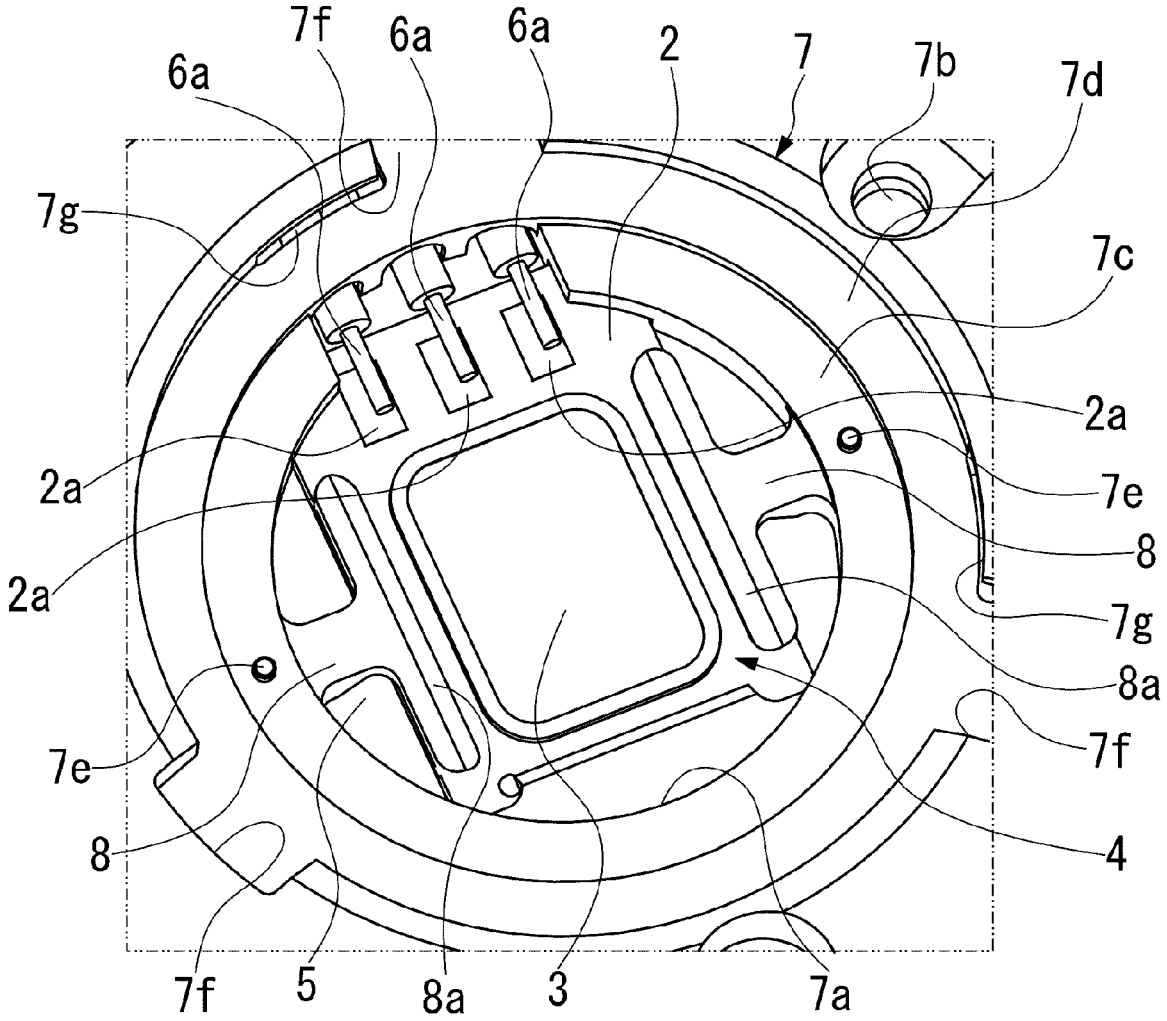
FIG. 2 is an enlarged perspective view of a main portion showing inside a hole of the housing in a state where a light-transmitting cover is removed, in the first embodiment.
Figure 3:
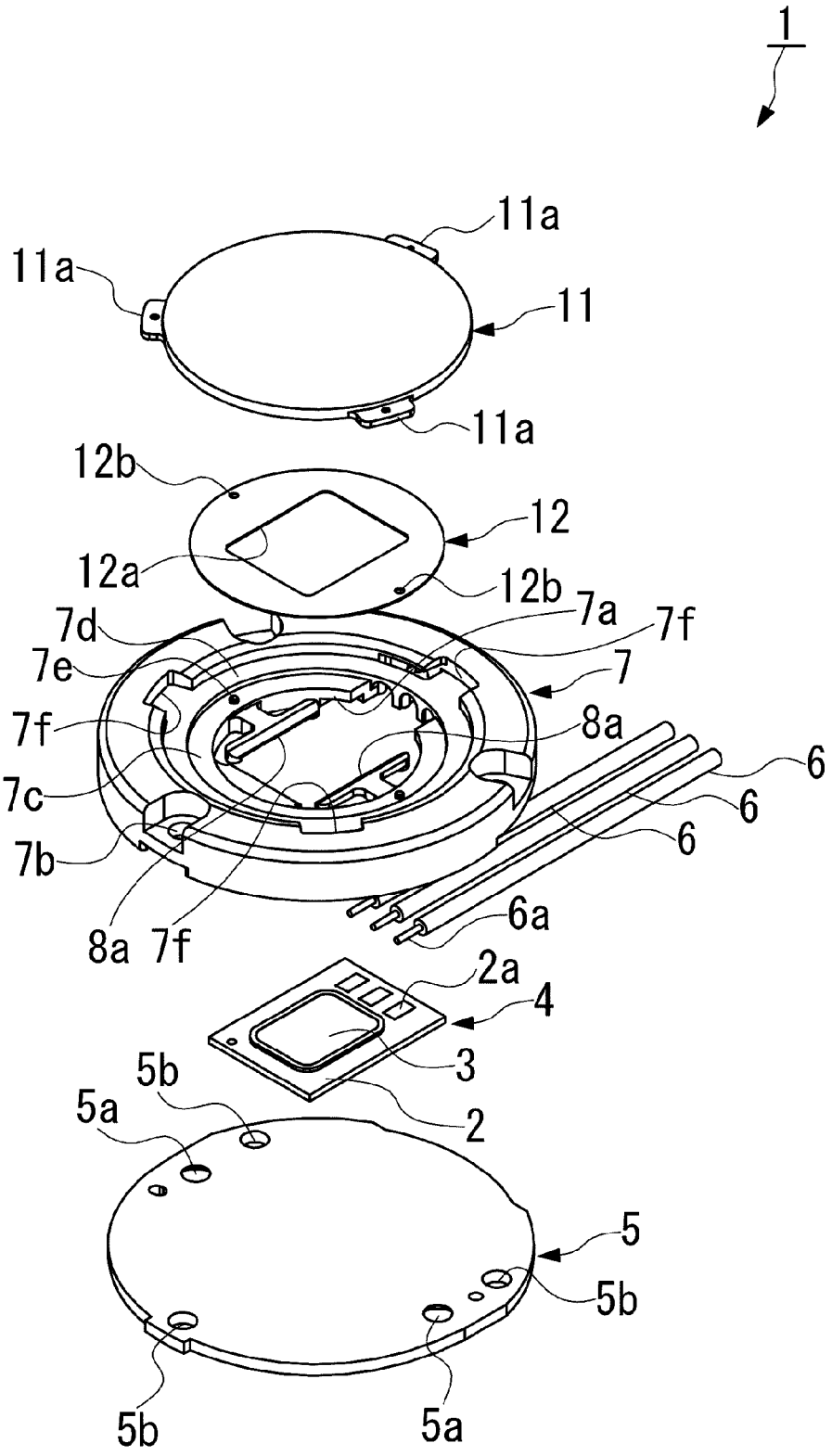
FIG. 3 is an exploded perspective view showing the light-emitting module in the first embodiment.

The present invention now will be described more fully hereinafter with reference to the accompanying drawings, in which embodiments of the invention are shown. The present invention may, however, be embodied in many different forms and should not be construed as limited to the specific embodiments set forth herein. Rather, these embodiments are provided to convey the scope of the invention to those skilled in the art. In the drawings, the size and relative sizes of layers and regions may be exaggerated for clarity.

FIGS. 1-4 show a first embodiment of the light-emitting module according to the present invention. In this embodiment, a light-emitting module 1 includes a metal plate 5, a light source 4 disposed on the metal plate 5, and a housing 7 made of resin, including a hole 7*a*, and secured to the metal plate 5 with the light source 4 positioned in the hole 7*a*, and the housing 7 includes at least one pair of protrusions 8 that hold the light source 4 against the metal plate 5. As the at least one pair of protrusions 8 flexibly hold the light source 4 against the metal plate 5, the light source 4 is secured to the metal plate 5 by the at least one pair of protrusions 8 without screws or adhesives between the protrusions 8 and the light source 4. The metal plate 5 may have substantially a disc shape overall, and the light source 4 may be positioned at a center of the metal plate 5 in the hole 7*a* of the housing 7.

This light source 4 may include a substrate 2, at least two electrodes 2*a* provided on the substrate 2, and at least one LED element 3 that is disposed on the substrate 2 and electrically connected to the at least two electrodes 2*a* provided on the substrate 2. The at least one LED element 3 is thermally connected to the metal plate 5. The at least two electrodes 2*a* provided on the substrate 2 of the light source 4 are electrically connected to at least two lead wires 6. Moreover, disposed in the hole 7*a* of the housing 7 are the light source 4, a part of a surface of the metal plate 5 on which the light source 4 is disposed, the at least two electrodes 2*a*, connecting portions of the at least two lead wires 6 to the at least two electrodes 2*a*, and the at least one pair of protrusions 8 that flexibly hold the light source 4 on the metal plate 5.

The light source 4 including the at least one LED element 3 is configured to emit white light, for example, and includes a light-emitting portion provided for example in a shape such as a round, an oval a square or a rectangular shape on the substrate 2. Note that in the present embodiment, one LED element 3 is disposed on the substrate 2, but the light source may also be configured to have a plurality of LED elements 3 disposed in the light-emitting portion of the light source 4.

The at least two electrodes 2*a* are formed by a metal film on the substrate 2, and in the present embodiment there are three of the electrodes 2*a* formed parallel with each other and positioned adjacent to one short side on the rectangular-shaped substrate 2. These electrodes 2*a* are electrically connected to the LED element 3 by a electrode pattern (not illustrated) formed on the substrate 2. In addition, a core 6*a* of each of the lead wires 6 is directly connected to each of the electrodes 2*a* by a solder material.

Note that in the present embodiment, a drive circuit configured to act as an AC-DC conversion circuit for rectifying an alternating current voltage and converting it to a direct current is provided externally, and a direct current voltage is applied to the light source 4 via the at least two lead wires 6.

The housing 7 may be resin molded from, for example, PBT (polybutylene terephthalate) which excels in heat resistance. This housing 7 includes an inner surface demarcating the hole 7*a*, and the at least one pair of protrusions 8 protrudes from the inner surface of the housing 7. Note that the protrusions in each pair of the at least one pair of protrusions 8 protrude from opposite positions of the inner surface of the housing 7, extend toward the light source 4 positioned in a center of the hole 7*a* of the housing 7 and flexibly hold the light source 4 against the metal plate 5 by leading edge portions of the protrusions. Each of the protrusions in each pair of the at least one pair of protrusions 8 includes a taper at a position adjacent to the light source 4, at the position where the light source 4 is held, that is, at the leading edge portion of each of the protrusions 8. Note that in the present embodiment, the leading edge portion of each of the protrusions 8 includes an extension extending along one side (that is adjacent to the extension) of the substrate 2 of the light source 4. An upper end of each of these extensions is configured to include a taper surface 8*a* chamfered and inclined down toward the LED element.

Figure 4:
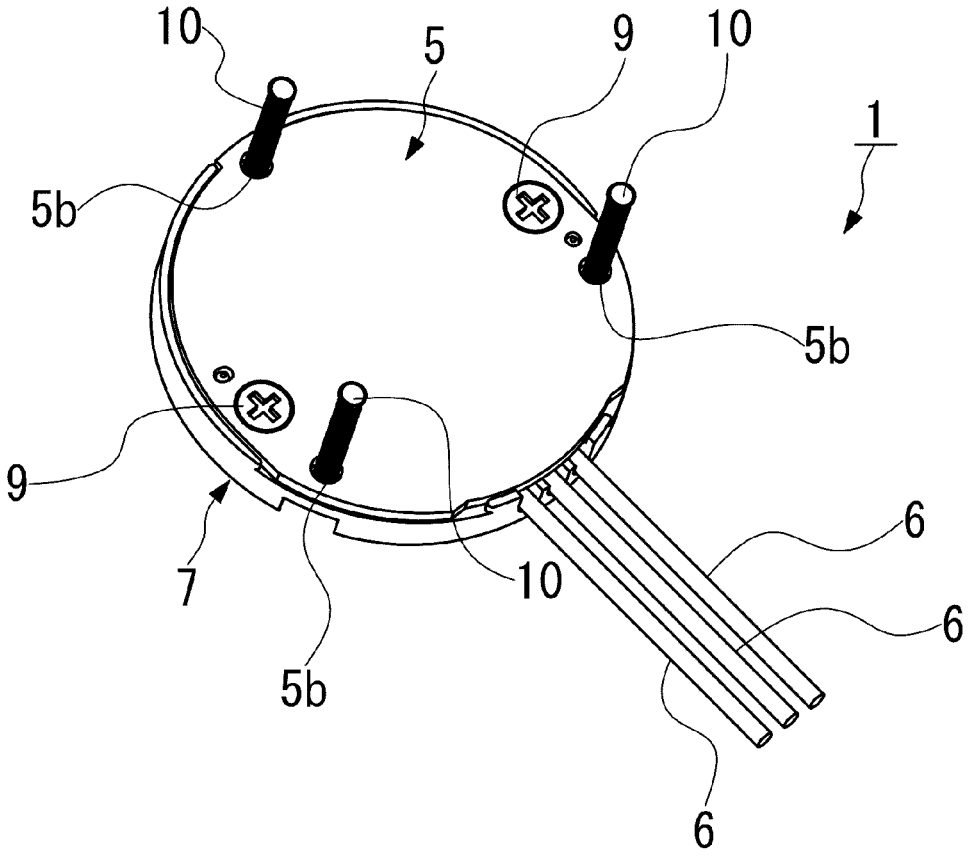
FIG. 4 is a perspective view as seen from a rear surface side showing the light-emitting module in a state where module attaching screws are inserted, in the first embodiment.

The metal plate 5 is formed by, for example, an aluminum plate having high heat dissipation properties, and is fixed to the housing 7 by fixing screws 9 as shown in FIG. 4. That is, the metal plate 5 may include screw holes 5*a*, and the fixing screws 9 are inserted from a rear side of the metal plate 5 into the screw holes 5*a* opened in the metal plate 5, and the fixing screws 9 are screwed into housing side screw holes (not illustrated) formed in an outer peripheral portion of the housing 7, and thus, the metal plate 5 and the housing 7 are fixed to one another.

At that time, the pair of protrusions 8 cause the light source 4 to be fixed by being sandwiched between the metal plate 5 and the housing 7 in a state of having a bias applied to the metal plate 5 side. Note that the light source 4 is disposed in an installation region on the metal plate 5 via a heat-conducting paste (not illustrated). It is preferable that the LED element 3 and the metal plate 5 are thermally connected to release heat from the LED element 3.

The metal plate side screw holes 5*a* have a rear surface side formed in a stepped hole shape and are set such that screw heads of the fixing screws 9 are housed within the metal plate side screw holes 5*a* whereby the rear surface of the metal plate 5 forms a flat surface. This allows a contact area between the flat rear surface of the metal plate 5 and an attaching surface of a lighting fixture or the like to be secured to a maximum degree, and high heat dissipation properties to be maintained.

In addition, housing side attaching holes 7*b* are formed in three places on an outer edge of the housing 7, and metal plate side attaching holes 5*b* are formed also on an outer edge of the metal plate 5 at positions corresponding to each of the housing side attaching holes 7*b*. For example, when attaching the light-emitting module 1 to a heat sink or the like on an external fixture side, respective module attaching screws 10 can be inserted through the three housing side attaching holes 7*b* and metal plate side attaching holes 5*b* and screwed into screw holes in the heat sink or the like, and thus, the light-emitting module is attached to the heat sink or the like.

Moreover, the light-emitting module 1 in the present embodiment comprises a light-transmitting cover 11 covering the hole 7*a* of the housing 7 and secured to the housing 7, and a white sheet 12 provided between the housing 7 and the light-transmitting cover 11 and including at least one opening provided at a position above the at least one LED element 3.

The light-transmitting cover 11 is formed substantially in a disc shape from resin or a glass material and has three attaching protrusions 11*a* formed on its outer edge.

The white sheet 12 is formed in a circular shape from PET (polyethylene terephthalate), is formed having an LED opening 12*a* of in a shape corresponding to dimensions of the light-emitting portion of the light source 4 and is formed to cover also directly above the electrodes 2*a*. Moreover, two attaching hole portions 12*b* are formed in an outer edge portion of the white sheet 12.

Formed in a periphery of the hole 7*a* of the housing 7 are a first step portion 7*c* which is annular in shape and enables the white sheet 12 to be disposed and positioned, and a second step portion 7*d* which is annular in shape, is provided in an outer periphery of the first step portion 7*c* and enables the light-transmitting cover 11 to be disposed and positioned.

Two attaching convex portions 7*e* corresponding to the attaching hole portions 12*b* of the white sheet 12 are formed in the first step portion 7*c*, and an orientation and position of the white sheet 12 is fixed by inserting the attaching convex portions 7*e* into the attaching hole portions 12*b* of the white sheet 12.

In addition, attaching concave portions 7*f* corresponding to the attaching protrusions 11*a* are formed in the second step portion 7*d*, and slits 7*g* are formed in one circumferential direction of the attaching concave portions 7*f* enabling the attaching protrusions 11*a* to be inserted in the circumferential direction. That is, by engaging the attaching protrusions 11*a* in the attaching concave portions 7*f* and rotating the light-transmitting cover 11 in the circumferential direction to insert the attaching protrusions 11*a* in the slits 7*g*, the light-transmitting cover 11 is fixed in a state of being engaged in the second step portion 7*d*. Note that the light-transmitting cover 11 and the housing 7 may also be fixed by screws.

As described above, in the light-emitting module 1 of the present embodiment, the housing 7 includes the hole 7*a* and includes the at least one pair of protrusions 8 that protrude from an inner surface that demarcates the hole 7*a* of the housing 7 and face one another inside the hole 7*a* and apply a flexible hold to the light source 4 to press the light source 4 against a metal plate 5 side, hence the at least one pair of protrusions 8 provided in an integrated manner to the housing 7 and having springiness allow the light source 4 to be held by pressing the light source 4 onto the metal plate 5. Therefore, even without an adhesive material being applied, holding reliability of the light source against the metal plate 5 is sufficient, and, since screw attachment is not employed, a creepage distance for insulation between the light source 4 and the metal plate 5 can be secured.

In addition, the light source 4 is fixed in a state of being pressed onto the metal plate 5 of high heat-conductivity to be in close contact with the metal plate 5, hence high heat dissipation properties can be obtained. Note that disposing the light source 4 on the metal plate 5 via a heat-conducting paste enables even higher heat dissipation properties to be obtained due to high heat conductivity of the heat-conducting paste.

Furthermore, since the at least one pair of protrusions 8 are provided to the housing 7 in an integrated manner, there is no need to separately attach a supporting member for the light source, thus allowing number of components to be reduced and enabling a lowering of costs to be achieved.

Moreover, the upper end of the leading edge portion of each of the protrusions 8 includes a taper 8*a* chamfered and inclined down toward the LED element 3, hence light emitted even in a wide angle from the LED element 3 (emission angle close to a substrate 2 surface which is a large angle close to 90° to an optical axis of the LED element 3) can be emitted without interference of the leading edge portions of the protrusions 8*a*. Note that adopting a white housing 7 also allows light emitted in a wide angle to be reflected toward the hole 7*a* above by the taper surface 8*a* of the upper end of the protrusions 8.

In addition, the lead wires 6 are connected beforehand to the electrodes 2*a* of the light source 4 and the light source 4 is fixed onto the metal plate 5 by the housing 7 to form a module, hence handling is facilitated, handling of attachability to a lighting fixture and electrical connectivity with a lighting fixture and so on is facilitated, and handling ability can be improved.

Furthermore, the light-transmitting cover 11 covering the hole 7*a* of the housing 7 and secured to the housing 7 is provided, hence contamination due to dust or dirt entering inside from the hole 7*a* can be prevented by the light-transmitting cover 11.

In addition, the white sheet 12 provided between the housing 7 and the light-transmitting cover 11 and including at least one opening provided at a position above the at least one LED element 3 is provided, hence, even if light emitted from the LED element 3 is reflected to the housing 7 side at a rear surface or inside the light-transmitting cover 11, such light can be reflected again to the light-transmitting cover 11 by the white sheet 12, allowing light to be emitted with even higher efficiency. Moreover, this white sheet 12 also covers directly above the at least two electrodes 2*a*, hence it can be prevented that the at least two electrodes 2*a* connected to the lead wires 6 by solder material are visible from external through the light-transmitting cover 11, and thus, external appearance without spoiling it can be achieved.

Next, second through fourth embodiments of a light-emitting module according to the present invention are described below with reference to FIGS. 5-10. Note that in the description of each of the embodiments below, identical symbols are assigned to configurative elements identical to those described in the above-mentioned embodiment, and a description of such elements is omitted.

Figure 5:
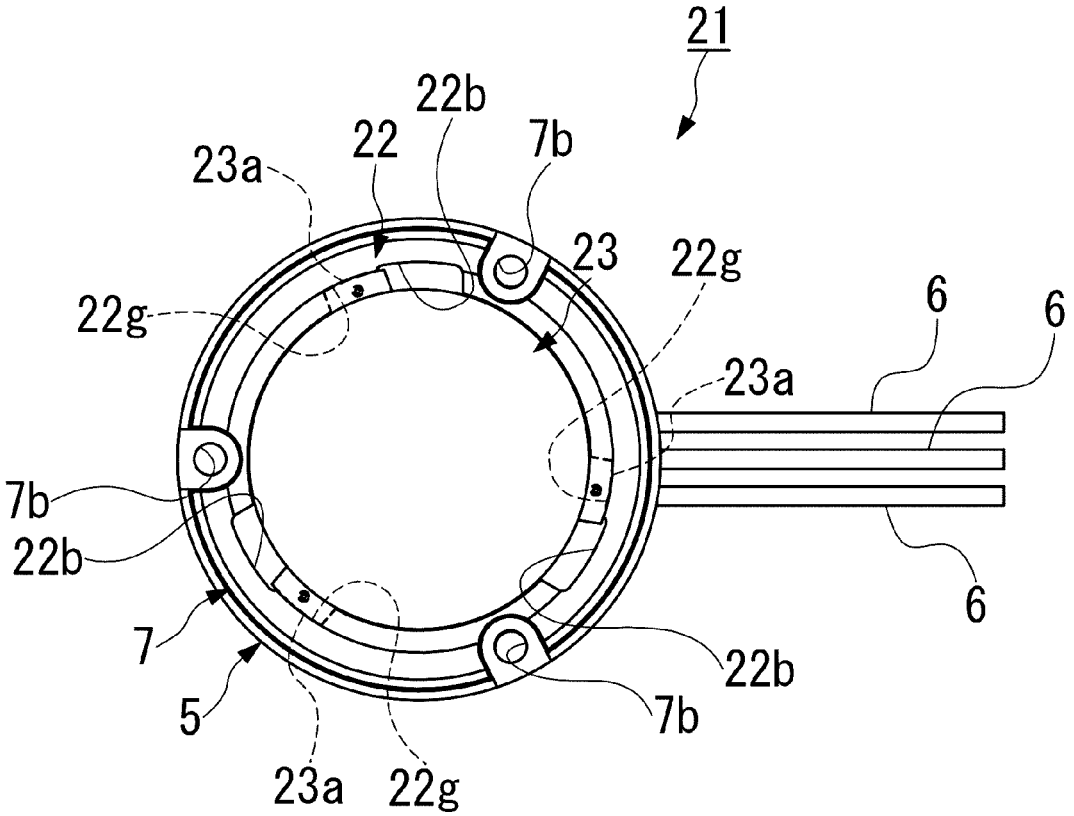
FIG. 5 is a plan view showing a second embodiment of a light-emitting module according to the present invention.
Figure 6:
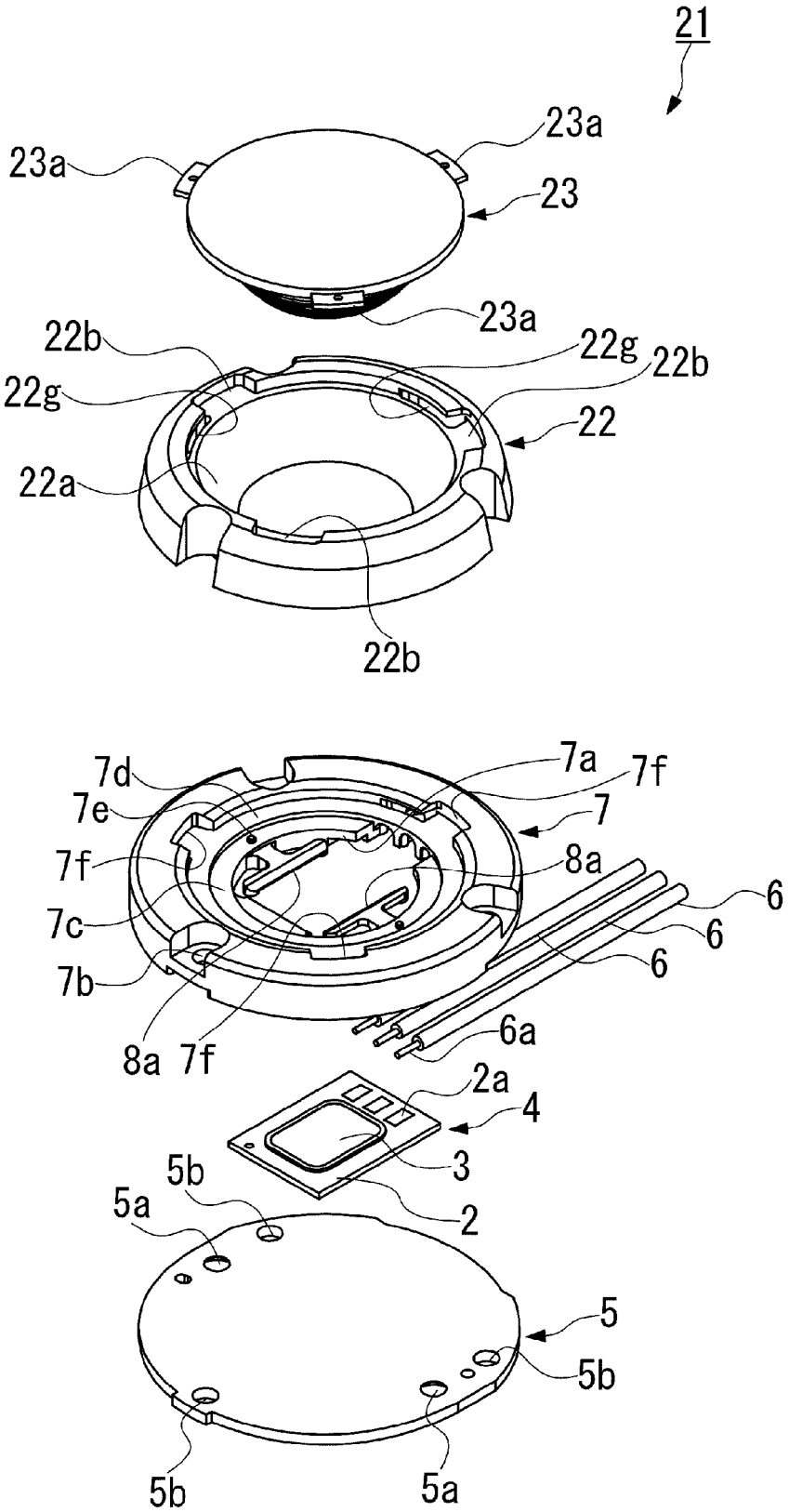
FIG. 6 is an exploded perspective view showing the light-emitting module in the second embodiment.

First, a second embodiment of a light-emitting module according to the present invention is described based on FIGS. 5 and 6. This second embodiment differs from the first embodiment in that whereas, in the first embodiment, the light-transmitting cover 11 is disposed to cover the hole 7*a*, in a light-emitting module 21 of the second embodiment, a lens member 23 is attached on the hole 7*a* via a lens holder 22. This lens member 23 is used to change a light path of light emitted from the light source 4 to focus the light.

That is, in the second embodiment, the lens holder 22 having an annular shape engages with the second step portion 7*d* of the housing 7, and the lens member 23 engages in the lens holder 22.

The lens member 23 may be a Fresnel lens formed in a substantially disc or a plate shape by, for example, resin or a glass material, and has three attaching protrusions 23*a* formed on an outer peripheral edge.

In addition, a lens disposing hole 22*a* is formed inside the lens holder 22, and holder side concave portions 22*b* corresponding to the attaching protrusions 23*a* are formed in an outer circumference of the lens disposing hole 22*a*. Moreover, slits 22*g* are formed in one circumferential direction of the holder side concave portions 22*b* enabling the attaching protrusions 23*a* to be inserted in the circumferential direction.

That is, by engaging the attaching protrusions 23*a* in the holder side concave portions 22*b* and rotating the lens member 23 in the circumferential direction to insert the attaching protrusions 23*a* in the slits 22*g*, the lens member 23 is fixed in a state of a Fresnel lens surface facing the light-emitting portion of the light source 4 and being engaged in the lens disposing hole 22*a*. Note that the lens member 23 and the lens holder 22 may also be fixed by screws. Moreover, if the lens member 23 is engagable with the second step portion 7*d*, the lens member 23 may be fixed by being engaged directly with the housing 7.

As described above, in the light-emitting module 21 of the second embodiment, the lens member 23 with the Fresnel lens surface for focusing light emitted from the light source 4 is attached on the hole 7*a* via the lens holder 22, hence light emitted from the light source 4 is focused by the lens member 23 to enable high directivity to be obtained.

Figure 7:
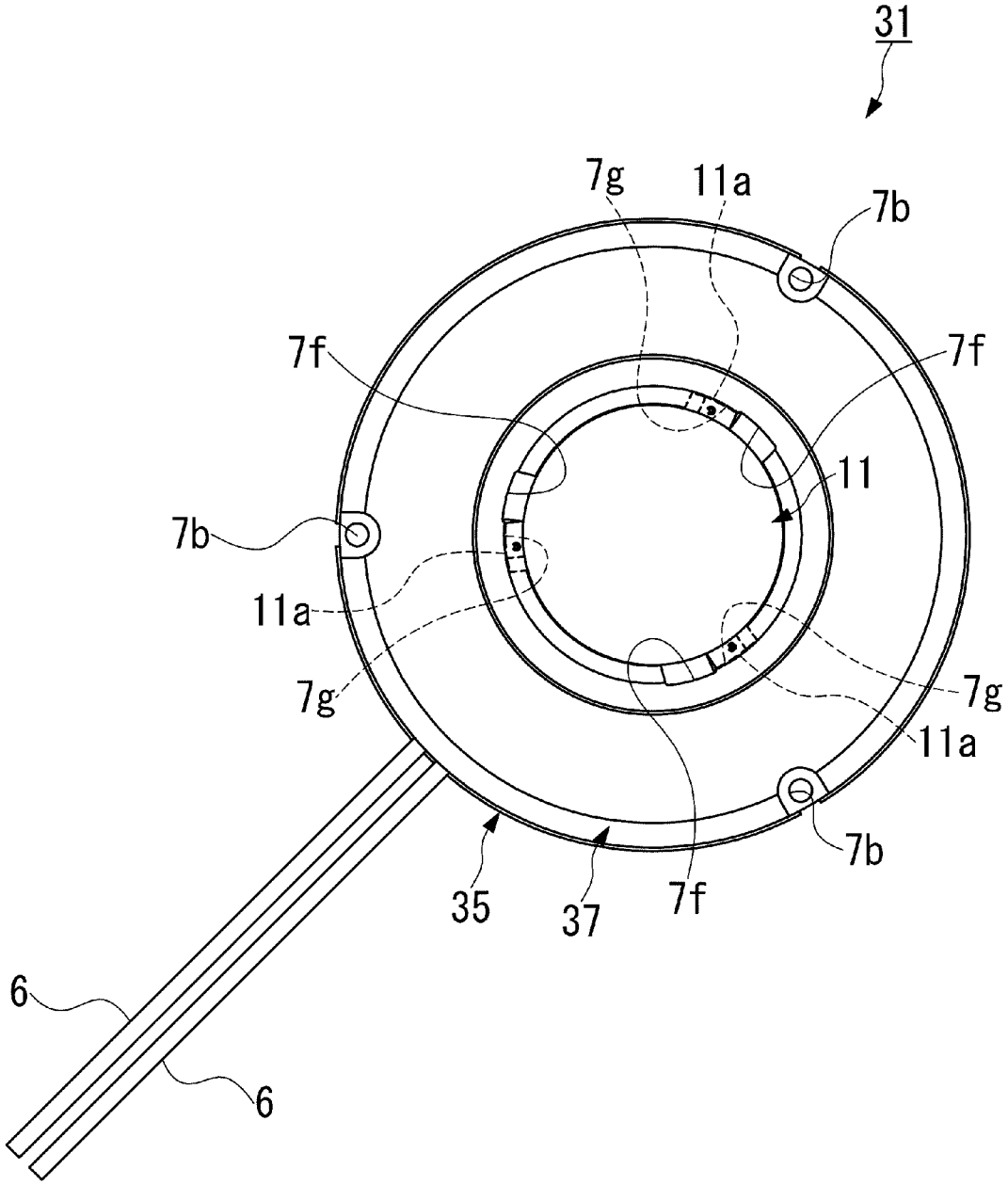
FIG. 7 is a plan view showing a third embodiment of a light-emitting module according to the present invention.
Figure 8:
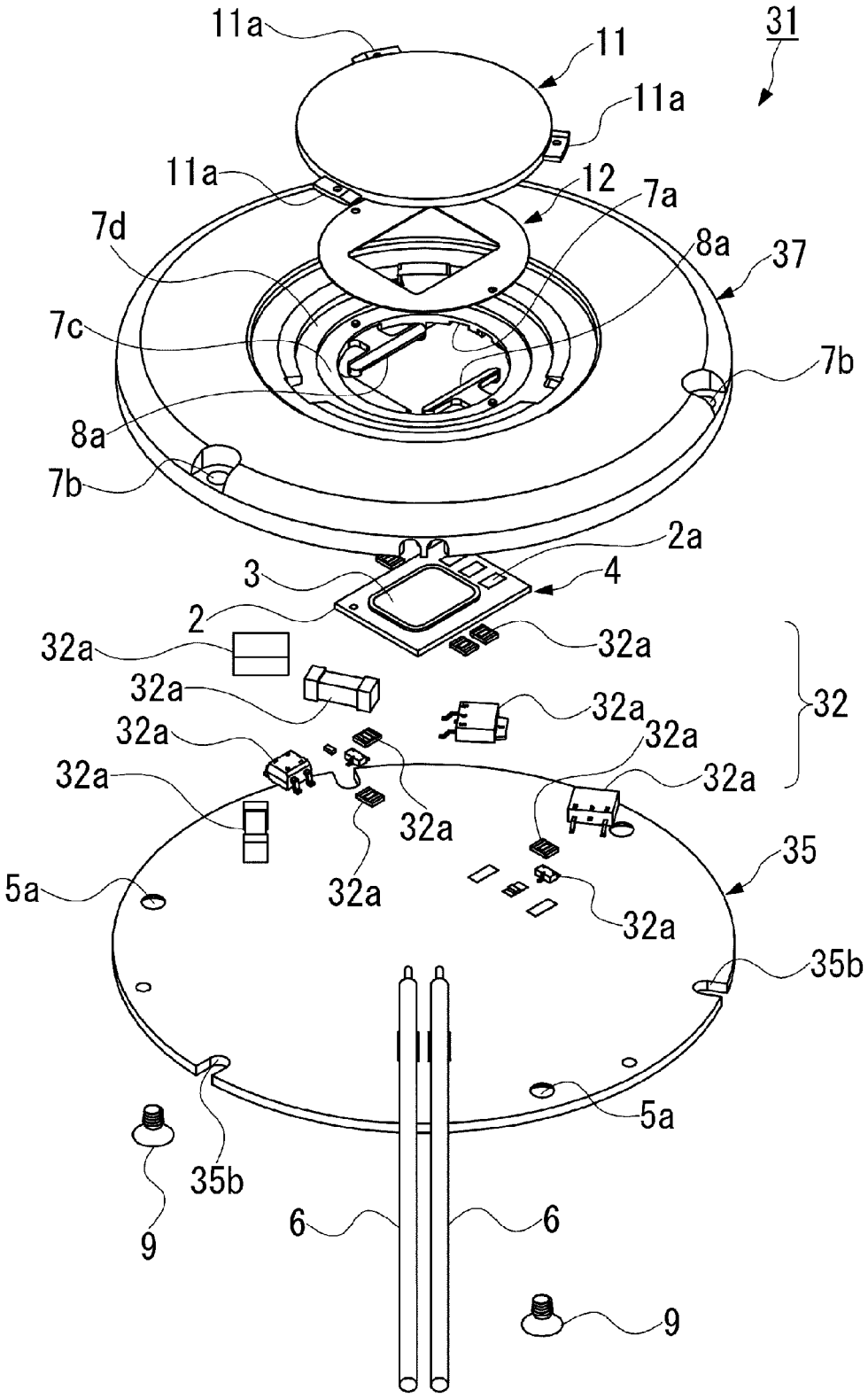
FIG. 8 is an exploded perspective view showing the light-emitting module in the third embodiment.

Next, a third embodiment of a light-emitting module according to the present invention is described based on FIGS. 7 and 8. This third embodiment differs from the first embodiment in that whereas, in the first embodiment, a drive circuit acting as an AC-DC conversion circuit is provided externally, in a light-emitting module 31 of the third embodiment, a drive circuit 32 for driving the LED element 3 is provided in a periphery of the light source 4 in a metal plate 35. In the third embodiment, an AC-DC conversion circuit, for example, is adopted as the drive circuit 32.

That is, in the third embodiment, a plurality of electronic components 32*a* configuring the drive circuit 32 are mounted in the periphery of the light source 4 mounted on the metal plate 35, and each of the electronic components 32*a* are connected by a wiring pattern (not illustrated) formed on the metal plate 35.

In this metal plate 35, an aluminum plate having an external diameter dimension larger than that in the first embodiment is employed, an insulating layer is formed on this aluminum plate, the wiring pattern is pattern-formed on the insulating layer from copper foil, and a solder mask is laminated on the wiring pattern and the insulating layer excluding mounting portions of each of the electronic components 32*a*. Note that an external diameter of a housing 37 is designed larger than that in the first embodiment corresponding to dimensions of the metal plate 35. Moreover, the core 6*a* of each of the lead wires 6 may be connected to electrodes (not illustrated) in the wiring pattern of the metal plate 35.

That is, in the third embodiment, the pair of lead wires 6 inputted with an alternating current voltage are electrically connected to the electrodes 2*a* via the wiring pattern of the drive circuit 32, and the inputted alternating current voltage, after being converted to a direct current by the drive circuit 32, is supplied to the LED element 3 via the at least two electrodes 2*a*.

Note that in the first embodiment, the metal plate side attaching holes 5*b* are formed at positions on the outer edge portion of the metal plate 5 corresponding to each of the housing side attaching holes 7*b*. However, in the metal plate 35 of the third embodiment, metal plate side attaching notch portions 35*b* are formed at positions on the outer edge portion corresponding to each of the housing side attaching holes 7*b*.

As described above, in the light-emitting module 31 of the third embodiment, the drive circuit 32 for driving the LED element 3 is provided in the periphery of the light source 4 in the metal plate 35, hence the LED element 3 can be driven without separately connecting an external drive circuit to the light-emitting module 31. For example, providing an AC-DC conversion circuit to the metal plate 35 as the drive circuit 32 enables the LED element 3 to be driven by direct connection to an alternating current power supply.

In addition, building-in of the drive circuit 32 allows overall size reduction of a lighting fixture to be achieved. Furthermore, having the drive circuit 32 provided on the metal plate 35 allows achievement of stable drive due to high heat dissipation properties of the metal plate 35 even if heat is generated by the electronic components 32*a* configuring the drive circuit 32.

Figure 9:
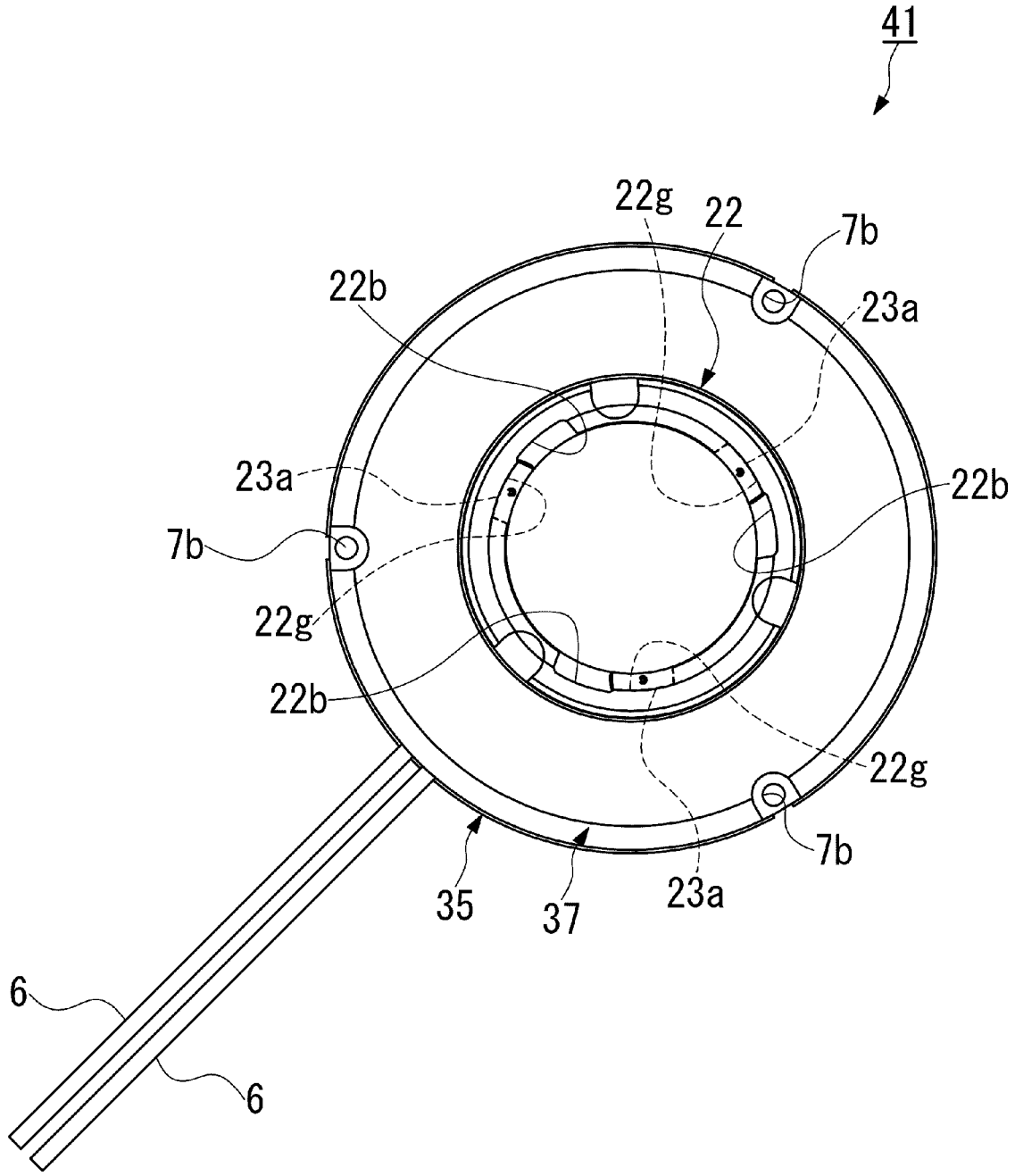
FIG. 9 is a plan view showing a fourth embodiment of a light-emitting module according to the present invention.
Figure 10:
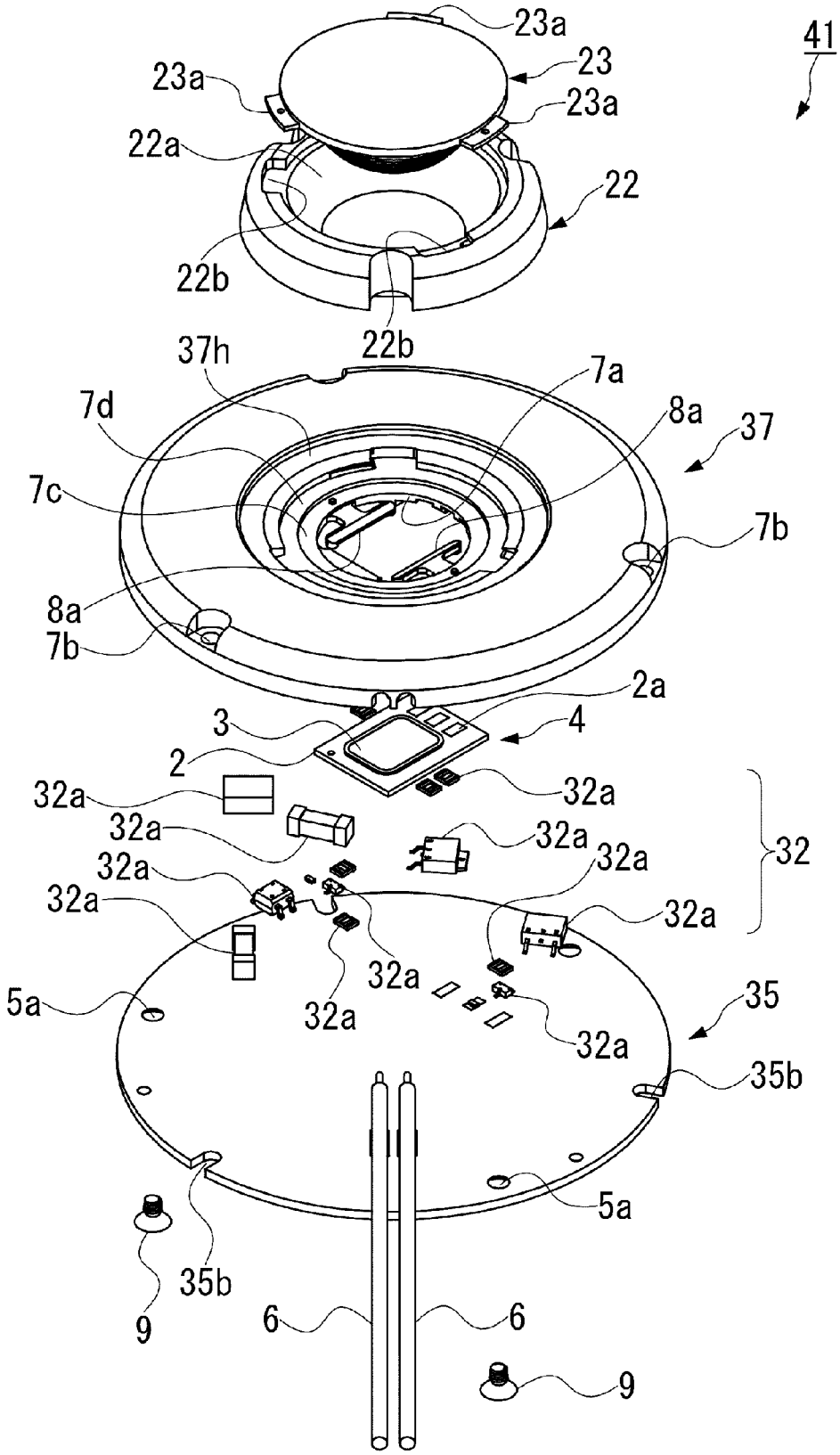
FIG. 10 is an exploded perspective view showing the light-emitting module in the fourth embodiment.

Next, a fourth embodiment of a light-emitting module according to the present invention is described based on FIGS. 9 and 10. This fourth embodiment differs from the third embodiment in that whereas, in the third embodiment, similarly to in the first embodiment, the light-transmitting cover 11 is disposed to cover the hole 7*a*, in a light-emitting module 41 of the fourth embodiment, similarly to in the second embodiment, the lens member 23 for changing a light path of light emitted from the light source 4 to focus the light is attached on the hole 7*a* via the lens holder 22.

That is, in the fourth embodiment, a lower portion of the lens holder 22 is fixed by being engaged in a third step portion 37*h* formed even more to an outer circumferential side than the second step portion 7*d*.

As described above, in the light-emitting module 41 of the fourth embodiment, the lens member 23 is attached on the hole 7*a* via the lens holder 22, hence, similarly to in the second embodiment, light emitted from the light source 4 is focused by the lens member 23 to enable high directivity to be obtained.

As described above, in the light-emitting module according to the present invention, a housing includes a hole and includes at least one pair of protrusions that protrude facing one another inside the hole and apply a flexible hold to the light source to press the light source against a metal plate side, hence good heat dissipation properties can be maintained, a high insulation withstand voltage can be obtained, and, moreover, a reduction in component costs can be achieved, without fixing reliability being impaired. Therefore, this light-emitting module having improved insulation performance facilitates attachability, electrical connectivity, and so on, to a lighting fixture regardful of electric shock and so on, whereby handling ability of the light source can also be improved.

Preferred embodiments of the present invention have been described above, but it should be understood that the present invention is not limited to the above-described embodiments, and that various alterations may be made to the embodiments within a range not departing from the spirit of the present invention.

What is claimed is:

1. A light-emitting module comprising:

a metal plate;

a light source including a substrate, at least two electrodes provided on the substrate, and at least one light-emitting diode element disposed on the substrate, and the at least one light-emitting diode element is thermally connected to the metal plate;

a housing made of resin, including a hole and secured to the metal plate with the light source positioned in the hole; and at least two lead wires electrically connected to the at least two electrodes provided on the substrate in the hole of the housing, the housing made of resin including at least one pair of resin protrusions that include leading edge portions directly and flexibly holding the substrate of the light source against the metal plate.

2. The light-emitting module according to claim 1:

the housing including an inner surface demarcating the hole, and the at least one pair of protrusions protruding from the inner surface of the housing.

3. The light-emitting module according to claim 2:

the protrusions in each pair of the at least one pair of protrusions protruding from opposite positions of the inner surface of the housing.

4. The light-emitting module according to claim 1:

each of the protrusions in the at least one pair of protrusions including a taper at each of the leading edge portions that are adjacent to the light source.

5. The light-emitting module according to claim 4:

wherein the taper is provided at an upper end of the each of the leading edge portions of the protrusions in the at least one pair of protrusions.

6. The light-emitting module according to claim 1:

wherein the metal plate is an aluminum plate.

7. The light-emitting module according to claim 1:

wherein each of the lead wires in the at least two lead wires is directly connected to each of the at least two electrodes provided on the substrate.

8. The light-emitting module according to claim 1: further comprising a drive circuit that is provided on the metal plate at a position around the light source.

9. The light-emitting module according to claim 1 further comprising:

a light-transmitting cover covering the hole of the housing and secured to the housing; and a white sheet provided between the housing and the light-transmitting cover and including at least one opening provided at a position above the at least one light-emitting diode element.

10. The light-emitting module according to claim 1 further comprising:

a lens member provided at the hole of the housing to collect light emitted from the light source.

11. The light-emitting module according to claim 10:

wherein the lens member is a Fresnel lens formed in a substantially disc shape by resin or a glass material.

12. The light-emitting module according to claim 1, wherein the resin housing including the at least one pair of protrusions is made of PBT (polybutylene terephthalate).

13. A light-emitting module comprising:

a metal plate;

a light source disposed on the metal plate, including a substrate, at least two electrodes provided on the substrate, and at least one light-emitting diode element that is disposed on the substrate and electrically connected to the at least two electrodes provided on the substrate;

a housing made of resin, including a hole and secured to the metal plate with the light source positioned in the hole;

the housing including an inner surface that demarcates the hole and at least one pair of resin protrusions protruding from the inner surface of the hole;

the at least one pair of protrusions including leading edge portions each with an extension extending along a side of the substrate of the light source and flexibly engaging with and directly holding the light source against the metal plate at leading edge portions of the protrusions; and at least two lead wires being electrically connected to the at least two electrodes provided on the substrate.

14. The light-emitting module according to claim 13:

each of the protrusions in the at least one pair of protrusions including a taper at a position that is adjacent to the light source.

15. The light-emitting module according to claim 14:

wherein the taper is provided at an upper end of the each of the protrusions in the at least one pair of protrusions.

16. The light-emitting module according to claim 13, wherein each of the leading edge portions of the at least one pair of protrusions includes an extension that extends along a side of the substrate of the light source.

17. A light-emitting module comprising:

a metal plate;

a light source comprising a substrate; and a housing made of resin, having a hole, and comprising at least one pair of protrusions that are made of resin and integral with the housing;

at least two lead wires electrically connected to the at least two electrodes provided on the substrate, in the hole of the housing, and wherein the protrusions protrude into an area of the hole and hold directly and flexibly the substrate of the light source against the metal plate.

18. The light-emitting module according to claim 17, wherein each of the at least one pair of protrusions comprises an extension along one side of the substrate, the one side of the substrate being adjacent to the extension.

19. The light-emitting module according to claim 17, wherein the at least one pair of protrusions directly hold the light source further pressed against the metal plate without screws or adhesives between the pair of the protrusions and the light source.

20. The light-emitting module according to claim 17, wherein the light source further comprises a light-emitting diode element disposed on the substrate.

* * * * *